US005538362A

United States Patent [19]

Akesaka et al.

[11] Patent Number: 5,538,362

[45] Date of Patent: Jul. 23, 1996

[54] SHIELD EXCAVATOR

[75] Inventors: Toshio Akesaka, Kanagawa-ken; Kazuto Hamada, Tokyo, both of Japan

[73] Assignee: Kabushiki Kaisha Iseki Kaihatsu Koki, Tokyo, Japan

[21] Appl. No.: 406,841

[22] Filed: Mar. 22, 1995

[30] Foreign Application Priority Data

Oct. 8, 1992 [JP] Japan ..... 4-293948

[51] Int. Cl.[6] ..... E21D 9/08

[52] U.S. Cl. ..... 405/141; 405/144

[58] Field of Search ..... 405/141, 144, 405/138, 184; 299/33, 108, 67; 175/91

[56] References Cited

U.S. PATENT DOCUMENTS

| | | | |
|---|---|---|---|
| 3,711,159 | 1/1973 | Mazzotti | 299/33 |
| 4,045,088 | 8/1977 | Bechem | 299/31 |
| 5,163,738 | 11/1992 | Linsingen-Heintzmann | 299/33 X |
| 5,190,407 | 3/1993 | Akesaka et al. | 405/141 |
| 5,211,507 | 5/1993 | Siseki et al. | 405/138 |
| 5,340,199 | 8/1994 | Piefenbrink et al. | 299/33 |

FOREIGN PATENT DOCUMENTS

| | | |
|---|---|---|
| 1310089 | 12/1989 | Japan . |
| 266295 | 3/1990 | Japan . |
| 4194194 | 7/1992 | Japan . |

OTHER PUBLICATIONS

International Search Report for International Application No. PCT/JP93/01455, dated Jan. 4, 1994.

International Preliminary Examination Report for International Application No. PCT/JP93/01455, dated Jul. 4, 1994.

*Primary Examiner*—Stephen J. Novosad

*Attorney, Agent, or Firm*—Webb Ziesenheim Bruening Logsdon Orkin & Hanson

[57] ABSTRACT

A shield excavator for constructing a tunnel, a hole, a groove and the like having a polygonal, preferably, square section. The excavator (10) comprises: a cylindrical shield body (12) having a polygonal sectional shape; a cutter assembly (18) disposed at a front end portion of the shield body (12) so as to be reciprocatingly movable in a first direction intersecting at least the axis of the shield body (12); and a driving mechanism (16) for driving the the cutter assembly (18). The cutter assembly (18) includes: a plurality of serrated cutters (66) disposed at the front end of the shield body (12) at intervals in a second direction intersecting the axis of the shield body (12) and the first direction and extending in the first direction, or a plurality of plate-shaped cutters (68) disposed at the front end of the shield body (12) at intervals in the first direction and extending in the second direction.

16 Claims, 6 Drawing Sheets

SHIELD EXCAVATOR

BACKGROUND OF THE INVENTION

1. Field of the Invention

This invention relates to a shield excavator to be used for constructing a tunnel, a hole, a groove and the like having a polygonal, preferably, rectangular section.

2. Description of the Prior Art

It is desired that a rectangular shield excavator for constructing a tunnel, a hole, a groove and the like having a polygonal section be able to excavate beautifully without excavating each corner portion of the polygonal shape to look like an arc.

As one of such rectangular shield excavators, there is disclosed an excavator using a cutter assembly including a plurality of support rods extending in a first direction orthogonal to the axis of a quadrangularly tubular shield body and reciprocally movable in a second direction orthogonal to both of the first direction and the axis of the shield body, and a plurality of cutters mounted on each support rod, each cutter having a pair of bits, i.e. edges extending in the first direction, at the end the cutter in the second direction (Japanese Patent Appln. Public Disclosure (KOKAI) No. 1-310089). This excavator excavates a facing by reciprocating motion of each cutter with the reciprocating motion in the second direction of the cutter assembly. In this excavator, however, since the cutters are disposed such that the edges or bits of the adjacent cutters in the first direction are continuous, it only scrapes off the whole facing in such a manner as to plane wood. Therefore, the excavation efficiency is low.

As another rectangular shield excavator, there is disclosed an excavator using a cutter assembly composed of a drum rotatable about an axis extending in the direction orthogonal to the axis of a quadrangularly tubular shield body, and a plurality of cutters mounted on the peripheral surface of the drum (Japanese Patent Appln. Public Disclosure (KOKAI) No. 2-66295). This excavator excavates a facing by a rotational movement of the cutters with the rotational movement of the drum. In this known excavator, however, most of the forward end portion of the shield body is closed by the drum. As a result, the quantity of earth and sand received into the shield body is only a little and accordingly the excavation efficiency is low. Further, since in this known excavator the excavated earth and sand is gathered up on one side of the excavator by the rotational movement of the cutters, a great driving force is required.

As the other rectangular shield excavator, there is disclosed one using a cutter assembly composed of a plurality of arms angularly rotatable about an axis extending in a first direction orthogonal to the axis of the quadrangularly tubular shield body, the arms extending onward and backward, a support rod mounted on the forward end of the arms, the support rod extending in the first direction, and a plurality of cutters mounted on the support rod (U.S. Pat. No. 3,711,159). This excavator excavates a facing by a reciprocating motion of the cutters with a swinging motion of the arms and the support rods. In this excavator, however, since the cutter assembly is moved, pushing aside the excavated earth and sand filled so as to prevent a facing from collapsing, a great driving force is required for driving the cutter assembly.

SUMMARY OF THE INVENTION

It is an object of the present invention to provide a shield excavator having a high excavating efficiency and not requiring a great driving force for driving a cutter assembly.

The shield excavator of the present invention comprises: a tubular shield body having a polygonal section; a cutter assembly disposed in the front end of the shield body so as to be reciprocatingly movable in a first direction intersecting at least the axis of the shield body; and a driving mechanism for driving the cutter assembly.

The cutter assembly includes a plurality of cutters selected from: a plurality of serrated cutters extending in the first direction, the serrated cutters being disposed at the front end of the shield body at intervals in a second direction intersecting both of the first direction and the axis of the shield body; and a plurality of plate-shaped cutters extending in the second direction, the plate-shaped cutters being disposed at the front end of the shield body at intervals in the first direction.

In case the cutter assembly has serrated cutters, the cutter assembly is reciprocatingly moved in the first direction while the excavator advances, so that due to both of the advance of the excavator and the reciprocating motion of the cutter assembly, each of the serrated cutters acts like a saw and excavates the facing. Thereby, the facing is divided into a plurality of blocks by the serrated cutters.

In case the cutter assembly has plate-shaped cutters, the cutter assembly is reciprocatingly moved in the first direction while the excavator advances, so that due to both of the advance of the excavator and the reciprocating motion of the cutter assembly, each of the plate-shaped cutters excavates the facing, whereby the facing is divided into a plurality of blocks by the plate-shaped cutters.

In either case, each of the divided blocks is received into the shield body with the advance of the excavator, through the space between adjacent cutters. Also, the earth and sand received into the shield body is discharged out of the excavator at last.

As mentioned above, according to the present invention, since the cutter assembly is reciprocatingly moved at least in the first direction and has a plurality of cutters selected from: a plurality of serrated cutters extending in the first direction and disposed at intervals in the second direction; and a plurality of plate-shaped cutters extending in the second direction and disposed at intervals in the first direction, a facing is divided by the plurality of cutters into a plurality of block forms. Consequently, the excavating efficiency is high, and there is no need to make a driving force for the cutters greater.

The above-mentioned cutter assembly is preferably provided with the plurality of serrated cutters and the plurality of plate-shaped cutters connected to the adjacent serrated cutters. By this, while the the excavator advances with the reciprocating movement of the cutter assembly, each of the serrated cutters acts like a saw to excavate the facing, and each of the plate-shaped cutters acts like a plow or scoop to excavate the facing, the facing is divided into a plurality of blocks by the serrated cutters as well as by the plate-shaped cutters. As a result, in comparison with using a cutter assembly provided with either serrated cutters or plate-shaped cutters, the excavating efficiency becomes higher and the driving force for the cutters can be made smaller.

The edge of each cutter can be directed at least onward. In this case, the driving mechanism is preferably a mechanism that moves each of the cutters such that the edge of each cutter is displaced toward one side of the excavator in the first direction while being displaced onward, and displaced toward the other side of the excavator in the first direction while being displaced backward. By this, the cutters are moved to cut into the facing when their bits are displaced to one side of the excavator in the first direction while being displaced onward and to go away from the facing when displaced toward the other side of the excavator in the first direction while being displaced backward, so that each cutter surely cuts into the facing, which can be excavated by a smaller driving force.

The driving mechanism is preferably provided with: a drive source disposed in the shield body; a crankshaft disposed in the shield body so as to be rotatable about an axis extending in the second direction, the crankshaft having eccentric portions in both ends; a transmitting mechanism for transmitting a rotation of the drive source to the crankshaft; and a pair of arms correspond to the eccentric portions, respectively, the arms being rotatably supported at their one ends by the corresponding eccentric portion while being connected to the cutter assembly at their other ends. By using such a driving mechanism, in comparison with a case where a jack such as a piston cylinder mechanism is used, the reciprocating frequency of cutters can be enhanced so as to excavate more efficiently. Also, since the cutter assembly makes such an eccentric movement as the edge of each cutter draws a circular trajectory, each cutter moves so as to surely cut into the facing, so that the cutting into the facing by the cutters are more assured.

The driving mechanism is preferably further provided with a link connected to the shield body at its one end so as to angularly rotate about an axis extending in the second direction, and connected to the cutter assembly at its other end so as to angularly rotate about an axis extending in the second direction. Thereby, since such a motion as the edge of each cutter reciprocatingly moves in the first direction while moving backward and forward. the excavating efficiency is enhanced.

In particular, the connecting point of the link with the cutter assembly in the first direction is preferably displaced closer toward the other side of the excavator in the first direction than toward the connecting point of the link with the shield body. By using such a drive mechanism, each cutter can be surely moved by a simple mechanism so that, along with a rotational movement due to the rotation of the crankshaft, the edge of each cutter may be displaced toward one side of the excavator in the first direction while being displaced onward and may be displaced toward the other side of the excavator in the first direction while being displaced backward.

In a preferred embodiment, a partition wall dividing the inside of the shield body into a front area and a rear area is included. In this case, excavated earth and sand is received from an inlet to the front area.

Further, in the preferred embodiment, a crusher body disposed in the rear of the cutter assembly and driven by the drive mechanism is included. The crusher body crushes gravels contained in the earth and sand entering between the crusher body and the partition wall or between the crusher body and the shield body, in cooperation with the partition wall or the shield body. This can prevent gravels in the earth and sand from hindering a discharge.

Still further, in the preferred embodiment, a pair of pipes for discharging the earth and sand received in the front area are included. The front area is provided with: a first chamber, where the crusher body is disposed, for receiving the earth and sand; and a second chamber for receiving the earth and sand in the first chamber through the space between the crusher body and the shield body as well as the space between the crusher body and the partition wall, the second chamber being communicated to the pipes. By this, since the earth pressure of the face is transmitted to the partition wall through the earth and sand filled in the first chamber, the second chamber can be utilized as a muddywater chamber.

The above-mentioned shield body can have a substantially rectangular section due to a pair of first external surfaces facing each other at an interval in the first direction and a pair of external surfaces facing each other at an interval in the second direction.

It is preferable for the shield body to be provided with: a first body portion where the cutter assembly is disposed; and a second body portion disposed in the rear of the first body portion. The first and the second body portions are connected so as to move in the directions to approach each other and to go away from each other by four jacks disposed in the shield body so as to individually correspond to the four corner portions of the rectangle. By this, though having a rectangular section, the excavator can correct its advancing direction.

In the preferred embodiment, the axis of the shield body, the first direction and the second direction are orthogonal to one another. Further, in the preferred embodiment, the excavator is used in such an attitude as the axial direction of the shield body and the second direction are horizontal.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENTS

Figure 1:
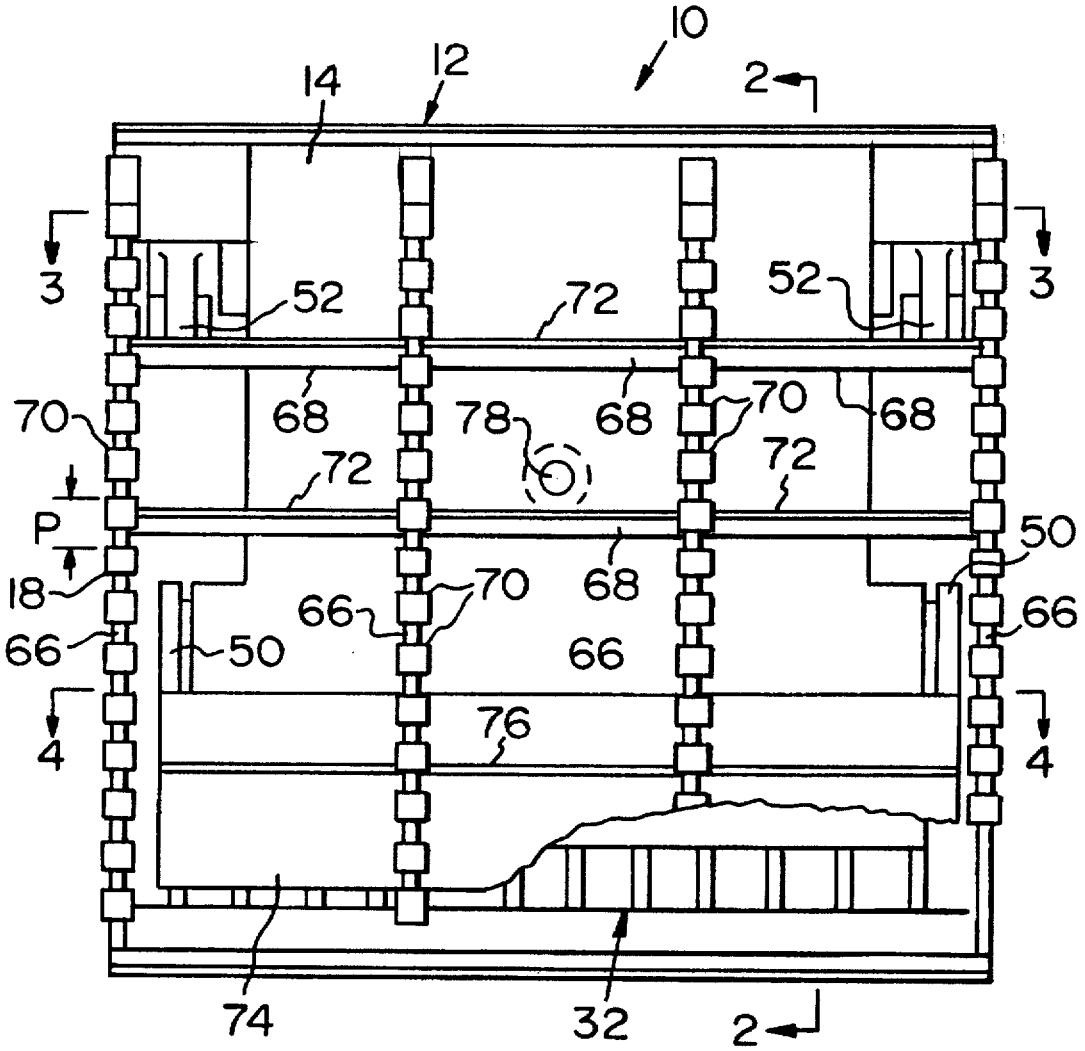
FIG. 1 is a front elevation showing an embodiment of a shield excavator according to the present invention.

Referring now to FIGS. 1 through 4, a rectangular shield excavator 10 comprises a quadrangularly tubular shield body 12, a partition wall 14 provided at the shield body 12, a driving mechanism 16 supported by the partition wall 14, and a cutter assembly 18 to be reciprocatingly moved by the driving mechanism 16 in a first direction (upward and downward in the drawing) orthogonal to the axis of the shield body 12 to excavate a facing.

The shield body 12 is divided into a quadrangularly tubular first body portion 20, and a quandrangularly tubular second body portion 22 received in the rear end of the first body portion. The first and second body portions 20, 22 are, as schematically shown in FIG. 6, connected to four direction-correcting jacks 24*a*, 24*b*, 24*c*, and 24*d* which are disposed so as to individually correspond to the four corner portions of the rectangular form.

The shield body 12 is advanced upon receipt of a thrust by a thrust generator (not shown) such as a jacking machine disposed in a vertical shaft through a plurality of quadrangularly tubular pipes 26 pushed into a tunnel excavated by the excavator 10. However, as a thrust generator, for example, a plurality of jacks may be used which are disposed in the space between the shield body and a lining constructed in a tunnel excavated and in which the lining is used as a reaction body. In case of using a plurality of jacks whose reaction is borne by the lining as a reaction body, these jacks may be used also as direction-correcting jacks.

The interior of the first body portion 20 is divided by the partition wall 14 into a front area 28 at the side of the facing, and a rear area 30 in the rear thereof, wherein the rear area is maintained at an atmospheric pressure. The front area 28 is divided by a grating 32 into a muck chamber, i.e., a first chamber 34 for receiving excavated earth and sand, and a muddy water chamber, i.e., a second chamber 36 following a rear end lower part of the first chamber 34. The second chamber 36 is connected to the rear of the first chamber 34 and formed at a lower part of the shield body 12. The second chamber 36 is connected to a pipe 38 for supplying muddy water, and a pipe 40 for discharging earth and sand together with the muddy water.

The drive mechanism 15 is provided with: a drive source 44 mounted on the partition wall 14 by a bracket 42; a crankshaft 46 supported at a lower part of the partition wall 14 so as to rotate about an axis extending in a second direction (in the right and left direction in FIG. 1) orthogonal to both of the axis of the shield body 12 and the first direction, the crankshaft 46 having eccentric portions at both ends of a main portion thereof; a transmitting mechanism 48 for transmitting a rotation of the drive source 44 to the crankshaft 46; a pair of arms 50 corresponding to the eccentric portions, respectively, and supported rotatably on the eccentric portions; and a pair of links 52 connected to an upper part of the partition wall 14 so as to angularly rotate about an axis extending in the second direction.

The drive source 44 is a well known one having a source of rotation such as an electric motor and a reduction gear connected to its output shaft. Also, the transmitting mechanism 48 is a well known one using a sprocket and a chain. However, other devices will do. Each arm 50 is connected at one end to the corresponding eccentric portion. Each link 52 is also connected at one end to the partition wall 14.

Figure 5:
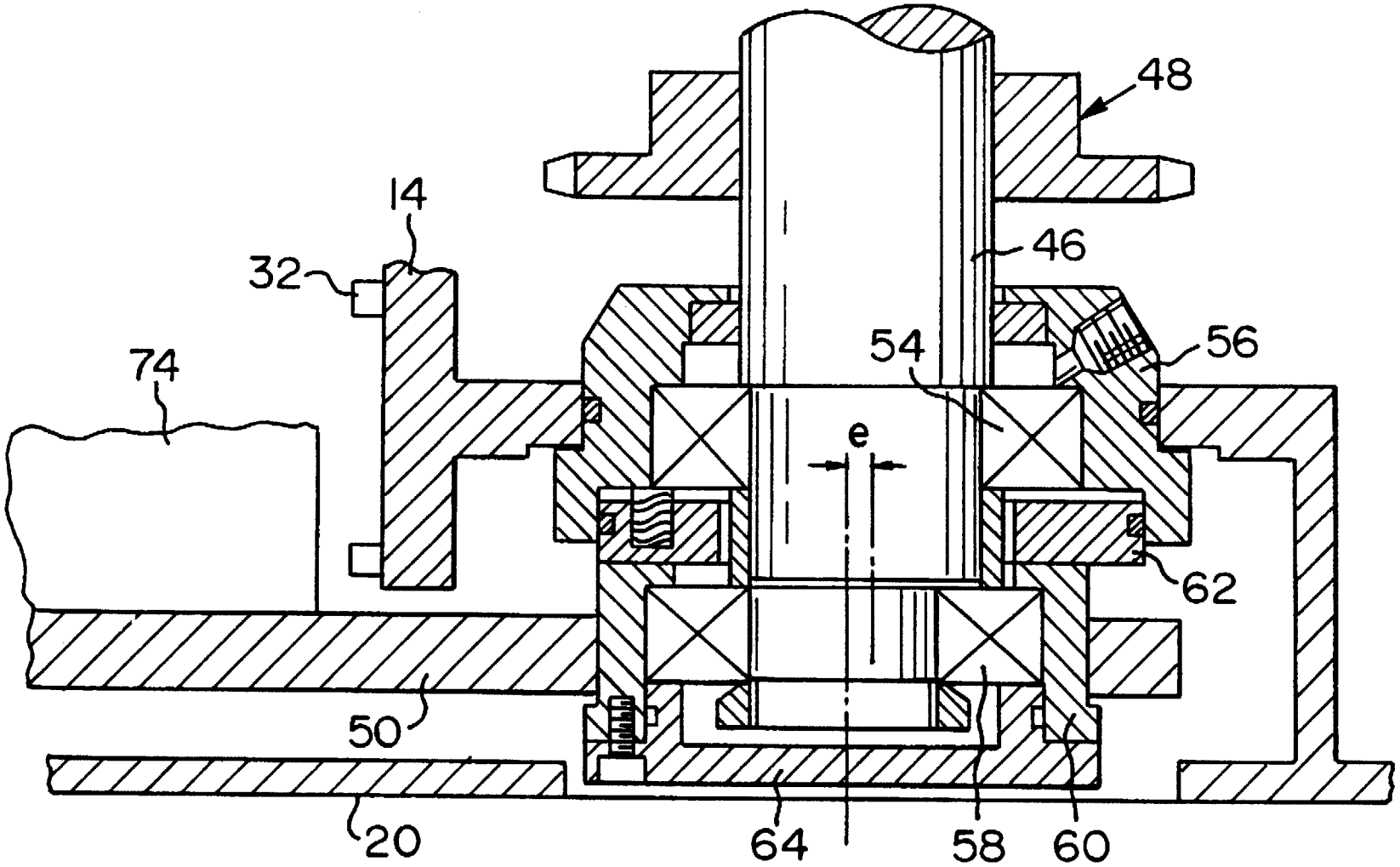
FIG. 5 is a sectional view showing an embodiment of the neighborhood of an end of a crankshaft.
Figure 6A:
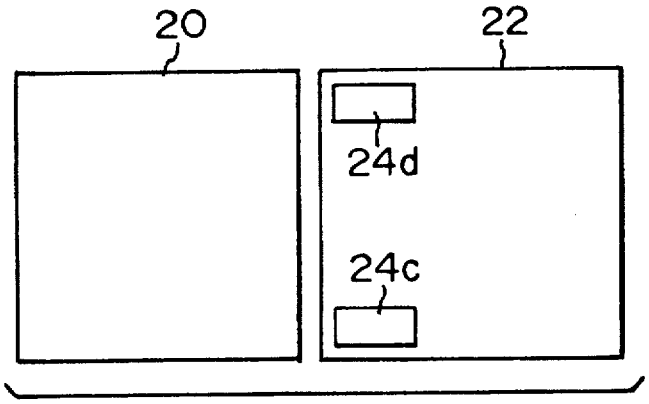
FIGS. 6 (A) to 6 (D) are for explaining a method for correcting the advancing directions.
Figure 6B:
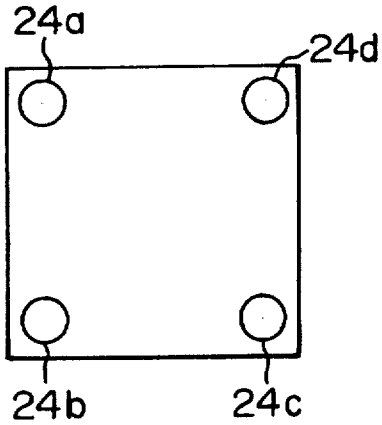
Figure 6C:
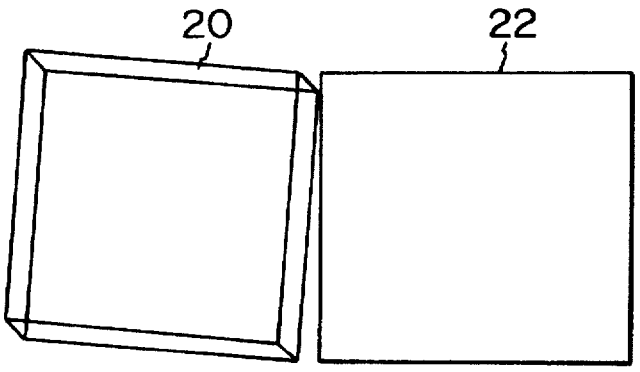
Figure 6D:
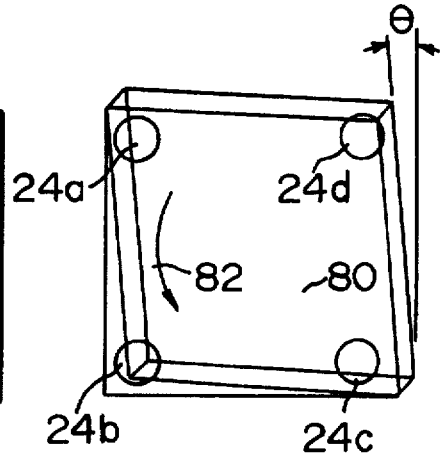

As shown in FIG. 5, the crankshaft 46 extends in the second direction (in the right and left direction in FIG. 1) above the second chamber 36, and is supported by the partition wall 14 at both ends of the main portion of the crankshaft 46 through a bearing 54 and a case 56, respectively. Each arm 50 is supported on the corresponding eccentric portion of the crankshaft 46 through a bearing 58 and a case 60. A mechanical seal 62 is disposed between the cases 56 and 60. A cap 64 is mounted in the case 60. Various seal members are disposed in the cases 56 and 60. The insides of the cases 56 and 60 are filled with a lubricant oil.

Figure 2:
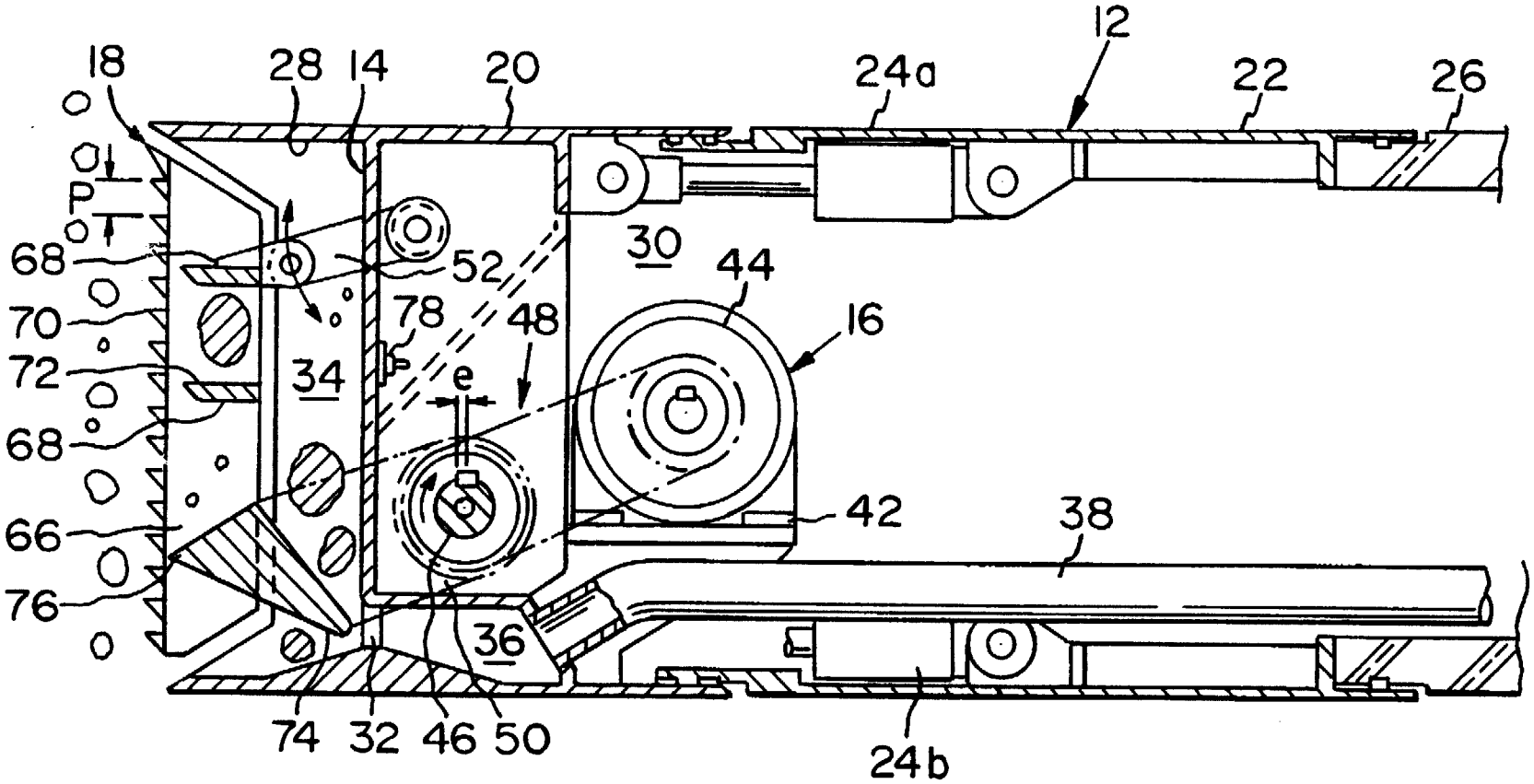
FIG. 2 is a sectional view taken along a line 2—2 in FIG. 1.
Figure 3:
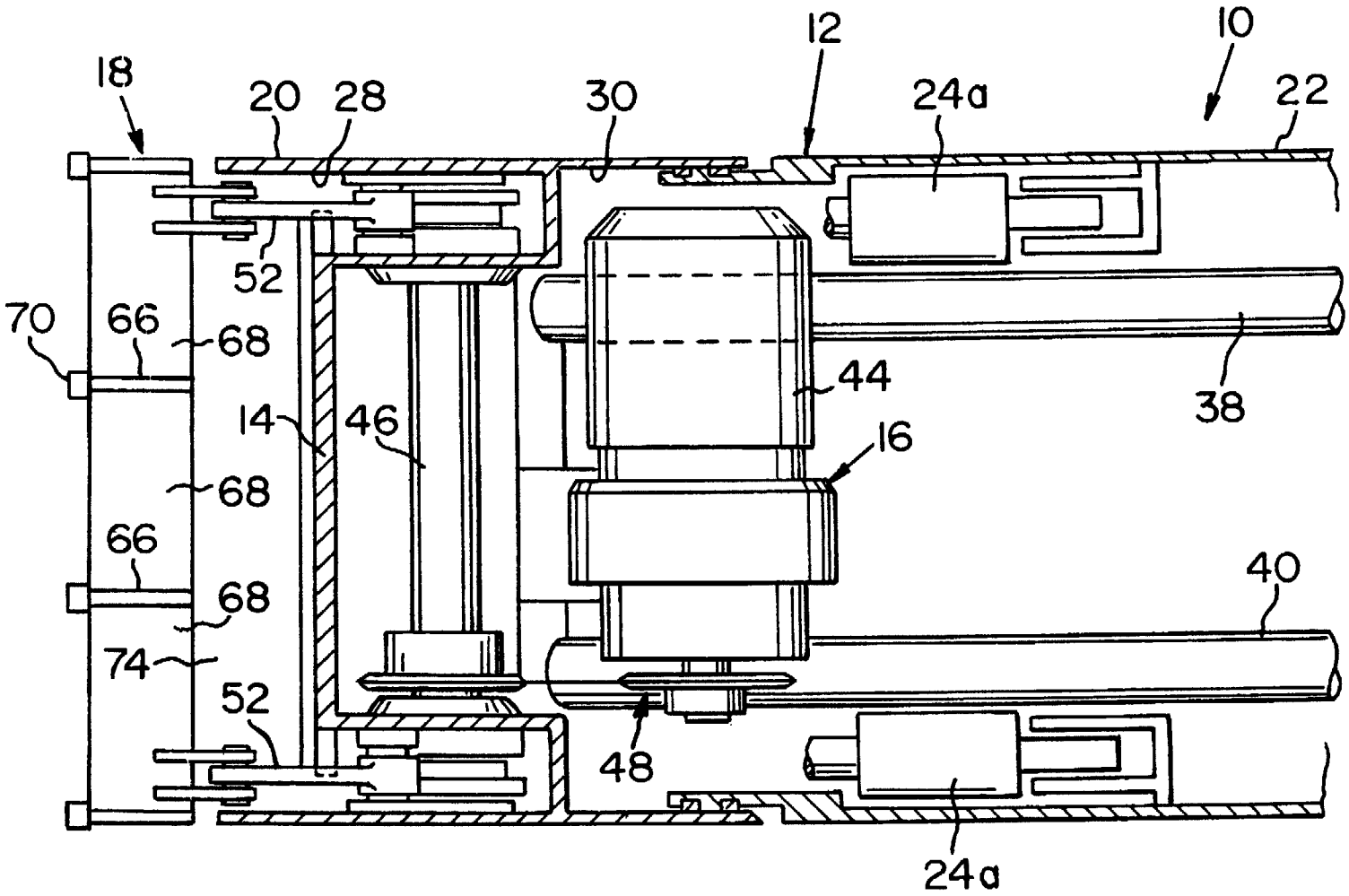
FIG. 3 is a sectional view taken along a line 3—3 in FIG. 1.
Figure 4:
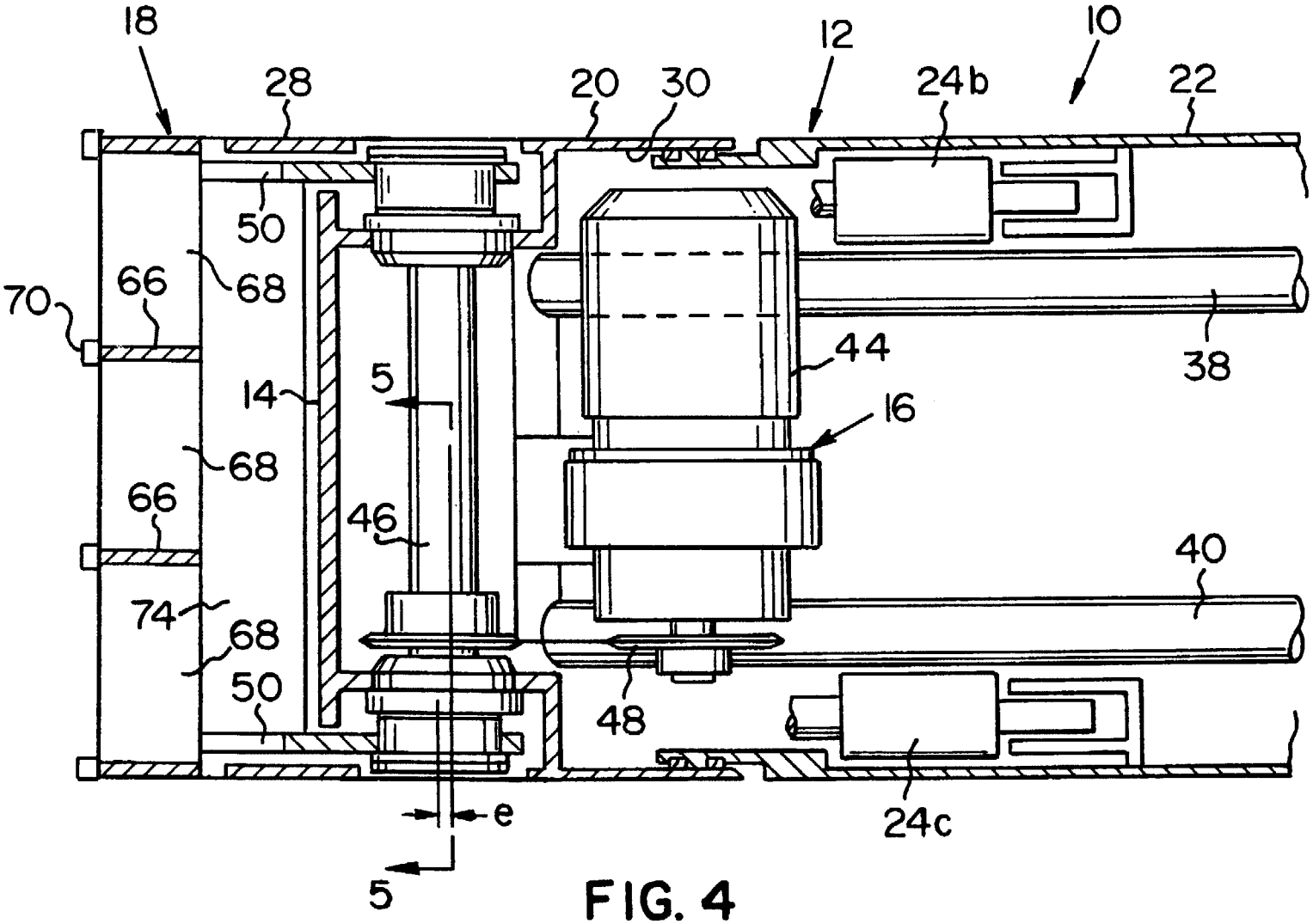
FIG. 4 is a sectional view taken along a line 4—4 in FIG. 1.

The cutter assembly 18 is disposed in the front end of the shield body 12, and connected to the front end of the arm 50 at the lower portion of the assembly 18 and to the front end of the link 52 at the upper portion of the assembly 18 so as to angularly rotate about the axes extending respectively in the second direction. As shown in FIG. 2, the connection point of the link 52 with the cutter assembly 18 is above the connection point of the link 52 with the shield body 12 and the partition wall 14.

The cutter assembly 18 includes a plurality of serrated cutters 56 extending in the first direction (the vertical direction) at intervals in the second direction (the right and left direction), and a plurality of plate- shaped connectors 58 connecting adjacent cutters 66 to each other and extending in the second direction at intervals in the vertical direction.

Each cutter 66 has its bit, i.e., edge 70 directed forward and upward, that is, in obliquely upward so as to excavate the facing when moved in the first direction. Each connector 68 defines an inlet of earth and sand in cooperation with adjacent cutters 66. The cutters 66 are disposed at a pitch P less than an amount of eccentricity e of the eccentric portion of the crankshaft 46.

Each connector 68 is secured to the adjacent cutters 66 so as to be horizontal. Each connector 68 is a plate-shaped cutter in the illustrated embodiment, and as a result, has its bit, i.e., edge 72 continuously extending in the second direction in the front edge portion of the main portion thereof. The edge 72 of each plate-shaped cutter 68 is directed forward and upward, that is, obliquely upward.

A crusher body 74 is disposed between the partition wall 14 and the cutter assembly 18. The crusher body 74 extends from the rear of the cutter assembly 18 to the space between the adjacent serrated cutters 66, and is unmovably connected to the arm 50 and the serrated cutters 66. The crusher body 74 has bits, i.e., edges 76 directed forward and extending successively in the second direction at its front edge portion.

In the excavator 10, since the eccentric portions of the crankshaft 46 are turned in the direction of the arrow in FIG. 2 about the axis of the crankshaft 45 when the drankshaft 45 is rotated by the drive source 44, the arms 50 make a swinging movement around the eccentric portion of the crankshaft 45, and reciprocatingly move the cutter assembly 18 upward and downward in cooperation with the link 52.

As a result, when the drive source 44 is operated in a state where the excavator 10 receives an advancing force, the cutter assembly 18 is reciprocatingly moved upward and downward in a range equal to or longer than the length of the arrangement pitch P of the serrated cutters 66. Consequently, due to the advance of the excavator 10 and the reciprocating motion of the cutter assembly 18, each of the serrated cutters 66 excavates the facing, functioning like a saw, while each of the plate-shaped cutters 68 and the crusher body 74 excavate the facing, functioning like a plow or a scoop.

Thereby, since a plurality of grooves extending in the vertical direction are formed in the facing by the serrated cutters 66, the facing is divided into a plurality of blocks by the serrated cutters 66. Also, each of the divided blocks is redivided further into a plurality of blocks by the plate-shaped cutters 58 and the crusher body 74. The redivided blocks are received into the first chamber 34 from the inlet defined by the serrated cutters 66 and the connectors 68.

The excavated earth and sand fills the first chamber 34, and the earth and sand in the first chamber 34 is received into the second chamber 35 after passing between the first body portion 20 and the crusher body 74 or between the partition wall 14 and the crusher body 74 and through the grating 32. The earth and sand in the second chamber 36 is discharged outside the excavator 10 from the second chamber 36 by the pipe 40 along with the muddy water fed to the second chamber 36 by the pipe 38. The pressure of the front area 28 is measured by a manometer 78 and maintained at a predetermined value so as to prevent the facing from collapsing.

When passing between the first body portion 20 and the crusher body 74 or between the partition wall 12 and the crusher body 74, large gravels contained in the redivided blocks are pressed by the crusher body 74 against the first body portion 20 or the partition wall 14, and thereby crushed into such a size as to pass the grating 32. The crushing efficiency between the crusher body 74 and the first body portion 20 may be enhanced by reversing the drive source 44 from time to time.

The arrangement pitch P of the serrated cutters 66 is equal to or less than the amount of eccentricity e of the crankshaft 46, preferably $$e=P\sim 3P.$$

or more preferably $$e=P\sim 1.5P.$$

In case the arrangement pitch P of the serrated cutters 66 is greater than e, the paths of movement of adjacent serrated cutters 66 are not continuous, so that continuous grooves in the first direction cannot be formed in the facing. On the other hand, in case the arrangement pitch P of the serrated cutters 66 is too small, the serrated cutters 66 become small, so that the mechanical strength of the serrated cutters 66 become small.

The dimension of each edge 70 in the second direction is preferably a little larger than the thickness of the main portion of the serrate cutters 66. Thereby, the reciprocating movement of the serrated cutters 66 becomes smooth.

Since the excavator 10 excavates the facing so as to divide it into a plurality of blocks by the serrated cutters 66, the plate-shaped cutters 68 and the crusher body 74, the excavating efficiency is higher than any other conventional excavator. Further, since the serrated cutters 66 move within the excavated grooves formed by themselves, there is no need to increase the drive force for the cutters.

Like the excavator 10, when the cutter assembly 18 is reciprocatingly moved by the rotation of the crankshaft 46, the reciprocating frequency of the cutters can be enhanced and more efficient excavation is enabled in comparison with a case where jacks such as a piston cylinder mechanism are used. Also, since the cutter assembly 18 makes such an eccentric movement as each cutter bit draws a circular trajectory about an axis extending in the horizontal direction orthogonal to the axis of the shield body 12, the serrated cutters 66 and the plate-shaped cutters 68 move so as to cut into the Facing, the serrated cutters 66 and the plate-shaped cutters 68 surely cut into the facing.

Instead of pivotally connecting the upper end of the cutter assembly 18 to the shield body 12 or the partition wall 14 by the link 52, the reciprocal movement of the cutter assembly 18 may be controlled by the guide and the like.

However, by pivotally connecting the upper end of the cutter assembly to the shield body 12 or the partition wall 14, the driving mechanism 16 becomes simpler than a case where guides and the like are used. Further, since it is possible to move each cutter such that each cutter bit is reciprocatingly cause moved and downward while each cutter bit is moved reciprocatingly onward and backward, the excavating efficiency can be enhanced.

in particular, the position of the connection point of the link 52 with the cutter assembly 18 in the vertical direction is preferably displaced to be lower than the position of the connection point of the link 52 with the partition 14 and the shield body 12. If such a drive mechanism is used, since the connection point of the link 52 with the cutter assembly 18 is displaced such as shown in the arcuate arrows in both directions in FIG. 2 together with the rotational movement of the crankshaft 46, each cutter can be surely moved by a simple mechanism so that at least each cutter bit can be displaced upward while being displaced forward, and displaced downward while being displaced backward.

When the serrated cutters 66 excavate the facing, a reaction force acts on the shield body 12. Since the reaction force at that time is a force to press down the shield body 12, there is little fear that the advancing direction of the excavator 10 is changed.

When the position of the excavator 10 relative to a planned reference line was changed, when the advancing direction of the excavator was changed, and when the advancing direction of the excavator is to be changed, the corrections can be made by the direction-correcting jacks 24*a*, 24*b*, 24*c*, and 24*d*.

To correct the advancing direction of the excavator rightward and leftward, for example in FIGS. 6 (A) and (B), it suffices to extend (or shrink) the jacks 24*a*, 24*b* or to shrink (or extend) the jacks 24*c*, 24*d*. Otherwise, the jacks 24*a*, 24*b* may be extended (or shrunk) while the jacks 24*c*, 24*d* are shrunk (or extended).

To correct the advancing direction of the excavator 10 to the vertical direction, for example in FIGS. 6 (A) and (B), it suffices to extend (or shrink) the jacks 24*a*, 24*d* or to shrink (or extend) the jacks 24*b*, 24*c*. Otherwise, the jacks 24*a*, 24*d* may be extended (or shrunk) while the jacks 24*b*, 24*c* are shrunk (or extended).

Further, to correct the advancing direction of the excavator 10 to a diagonal direction of a rectangle, for example in FIGS. 6 (C) and (D), the jack 24*b* may be shrunk (or extended) while the jack 24*d* is shrunk (or extended) in a state where the jacks 24*a*, 24*c* are not shrunk. By so doing, the first body portion 20 is inclined by angle θ relative to the second body portion 22, so that the rolling in the direction of the arrow 82 can be corrected.

The above direction-correcting technique can be applied not only to the excavator 10 but to any known rectangular shield excavators described in the Prior Art. In this case, too, the shield body may not necessarily be divided into the first and second body portions and the jacks for thrusting may also be used for the direction correcting jacks.

Further, instead of using the excavator 10 to make the reciprocating movement direction of the serrated cutters 66 upward and downward, the excavator 10 can be used in a state where it is rotated by 90° about its axis so that the reciprocating direction of the serrated cutters 66 may become rightward and leftward, or the excavator may be advanced upward and downward or diagonally for constructing a hole or the like extending in the vertical direction of diagonal direction. Also, to construct a tunnel or the like of a large area, it suffices to arrange a plurality of excavators 10 by overlapping them in a grating or a matrix state.

The present invention can be applied not only to an excavator having a rectangular section but also to an excavator having a polyhgonal section such as a hexagon, octagon and others.

What we claim:

1. A shield excavator comprising:

a tubular shield body having a polygonal section;

a cutter assembly disposed in the front end of the shield body so as to reciprocatingly move in a first direction intersecting at least the axis of said shield body; and a driving mechanism for driving the cutter assembly;

wherein said cutter assembly includes a plurality of cutters selected from: a plurality of serrated cutters disposed in the front end of said shield body at intervals in a second direction intersecting the axis of said shield body and said first direction, said serrated cutters extending in said first direction; and a plurality of plate-shaped cutters disposed in the front end of said shield body at intervals in the first direction, said plate-shaped cutters extending in said second direction.

2. An excavator according to claim 1, wherein said cutter assembly includes said serrated cutters.

3. An excavator according to claim 1, wherein said cutter assembly includes said plate-shaped cutters.

4. An excavator according to claim 1, wherein said cutter assembly includes said plurality of serrated cutters and said plurality of plate-shaped cutters, and wherein each said plate-shaped cutter is connected to the adjacent serrated cutter.

5. An excavator according to claim 1, wherein an edge of each cutter is directed at least forward.

6. An excavator according to claim 4, wherein said driving mechanism is a mechanism for moving each said cutter so that at least the edge of each cutter may be displaced to one side of said first direction while being displaced forward as well as to the other side of said first direction while being displaced backward.

7. An excavator according to claim 6, wherein said driving mechanism includes a link connected with said cutter assembly and said shield body, the connecting point of said link with said cutter assembly in said one direction being more displaced toward the other side of said first direction than the connection point of said link with said shield body.

8. An excavator according to claim 5, wherein said driving mechanism includes: a drive source disposed in said shield body; a crankshaft disposed in said shield body rotatably about an axis extending in said second direction, the crankshaft having an eccentric portion in each end; a transmitting mechanism for transmitting a rotation of said drive source to said crankshaft; and a pair of arms, each arm corresponding to said eccentric portion and its one end being rotatably supported by said corresponding eccentric portion while its other end being connected to said cutter assembly.

9. An excavator according to claim 8, wherein said driving mechanism further includes: a link of which one end is connected to said shield body so as to angularly rotate about an axis extending in said second direction and the other end is connected to said cutter assembly so as to angularly rotate about an axis extending in said second direction.

10. An excavator according to claim 1, further comprising a partition wall for dividing the interior of said shield body into a front area and a rear area.

11. An excavator according to claim 10, further comprising a crusher body disposed in the rear of said cutter assembly and driven by said driving mechanism, said crusher body crushing gravels contained in the earth and sand entering between the crusher body and said partition wall or between the crusher body and said shield body, in cooperation with said partition wall or said shield body.

12. An excavator according to claim 10, further comprising a pair of pipes for discharging the earth and sand received in said front area, said front area including: a first chamber for receiving said earth and sand and disposing said crusher body; and a second chamber for receiving the earth and sand in the first chamber through the space between said crusher body and said shield body as well as the space between said crusher body and said partition wall, said second chamber being communicated to said pipes.

13. An excavator according to claim 1, wherein said shield body has a substantially rectangular section due to a pair of first exterior portions facing each other at an interval in said first direction and a pair of second exterior portions facing each other at an interval in said second direction.

14. An excavator according to claim 13, wherein said shield body includes a first body portion where said cutter assembly is disposed and a second body portion disposed in the rear of the first body portion, and wherein said first and second body portions are connected movably in the directions to approach each other and to go away from each other by means of four jacks disposed to individually correspond to the four corner portions.

15. An excavator according to claim 1, wherein the axis of said shield body, said first direction and said second direction are orthogonal to one another.

16. An excavator according to claim 15, wherein the axis of said shield body and said second direction are horizontal, and wherein said first direction is vertical.

* * * * *

UNITED STATES PATENT AND TRADEMARK OFFICE

CERTIFICATE OF CORRECTION

PATENT NO. : 5,538,362

DATED : July 23, 1996

INVENTOR(S) : Toshio Akesaka and Kazuto Hamada

It is certified that error appears in the above-indentified patent and that said Letters Patent is hereby corrected as shown below:

Title page, delete "[22] Filed: Mar. 22, 1995" and insert the following:

--[22] PCT Filed: Oct. 8, 1993
[86] PCT No.: PCT/JP93/01455
§ 371 Date: Mar. 22, 1995
§ 102(e) Date: Mar. 22, 1995
[87] PCT Pub. No.: WO 94/09257
PCT Pub. Date: Apr. 28, 1994--.

Title page, item '[57] ABSTRACT', line 8 "the the" should read --the--.

Column 1 Line 26 after "end" insert --of--.

Column 2 Line 55 "the the" should read --the--.

Column 3 Line 37 "forward." should read --forward,--.

Column 4 Line 8 "muddywater" should read --muddy water--.

Column 4 Line 47 after "are" insert --illustrations--.

Column 5 Line 26 "15" should read --16--.

Column 5 Line 27 "wail" should read --wall--.

Column 6 Line 2 "cutters 56" should read --cutters 66--.

UNITED STATES PATENT AND TRADEMARK OFFICE

CERTIFICATE OF CORRECTION

PATENT NO. : 5,538,362

DATED : July 23, 1996

INVENTOR(S) : Toshio Akesaka and Kazuto Hamada

It is certified that error appears in the above-indentified patent and that said Letters Patent is hereby corrected as shown below:

Column 6 Line 4 "plate- shaped" should read --plate-shaped--.

Column 6 Line 4 "58" should read --68--.

Column 6 Line 8 before "obliquely" delete "in".

Column 6 Line 30 "45" should read --46-- (both occurrences).

Column 6 Line 30 "drankshaft" should read --crankshaft--.

Column 6 Line 33 "45," should read --46,--.

Column 6 Line 51 "58" should read --68--.

Column 6 Line 56 "35" should read --36--.

Column 7 Line 23 "become" should read --becomes--.

Column 7 Line 26 "serrate" should read --serrated--.

Column 7 Line 45 "Facing," should read --facing,--.

Column 7 Line 56 "cause moved" should read --moved upward--.

Column 7 Line 59 "in" should read --In--.

UNITED STATES PATENT AND TRADEMARK OFFICE

CERTIFICATE OF CORRECTION

PATENT NO. : 5,538,362

DATED : July 23, 1996

INVENTOR(S) : Toshio Akesaka and Kazuto Hamada

It is certified that error appears in the above-indentified patent and that said Letters Patent is hereby corrected as shown below:

Column 8 Line 39 "direction correcting" should read --direction-correcting--.

Column 8 Line 48 "of diagonal" should read --or diagonal--.

Column 8 Line 53 "polyhgonal" should read --polygonal--.

Signed and Sealed this

Tenth Day of December, 1996

*Attest:*

Bruce Lehman

*Attesting Officer*

BRUCE LEHMAN

*Commissioner of Patents and Trademarks*